United States Patent [19]

Sun et al.

[11] 4,319,574

[45] Mar. 16, 1982

[54] ACUPRESSURE DEVICE

[75] Inventors: Evelyn L. Sun, Cynwyd; Robert J. Sun, Easton, both of Pa.

[73] Assignee: Suntex Products, Inc., Easton, Pa.

[21] Appl. No.: 152,551

[22] Filed: May 23, 1980

Related U.S. Application Data

[63] Continuation of Ser. No. 897,278, Apr. 17, 1978, abandoned.

[51] Int. Cl.[3] ..... A61H 39/04

[52] U.S. Cl. ..... 128/303 R; 128/329 A

[58] Field of Search ..... 128/303 R, 907, 329 A, 128/329 R; 63/12, 13, 14 R, 14 A, 14 B, 14 C, 14 D, 14 E, 14 F, 14 G

[56] References Cited

U.S. PATENT DOCUMENTS

| | | | |
|---|---|---|---|
| 2,407,098 | 9/1946 | Raiche | 63/14 B |
| 2,775,014 | 12/1956 | Goclobin | 63/14 B |
| 2,795,118 | 6/1957 | Shill | 63/14 B |
| 3,923,064 | 12/1975 | Leupold | 128/329 A |
| 3,993,077 | 11/1976 | Kim | 128/329 A |
| 4,073,296 | 2/1978 | McCall | 128/303 R |
| 4,122,852 | 10/1978 | Knetsch et al. | 128/303 R |

FOREIGN PATENT DOCUMENTS

| | | | |
|---|---|---|---|
| 11148 | of 1908 | United Kingdom | 63/12 |
| 21841 | of 1908 | United Kingdom | 63/13 |
| 25921 | of 1911 | United Kingdom | 63/14 G |
| 806152 | 12/1958 | United Kingdom | 63/14 B |

OTHER PUBLICATIONS

*Midnight* vol. 21, No. 47 "Acu-Button Helps You Kick Bad Habits", 5-26-75.

"Auricular ACU Mold Pressure Therapy and ACU Mold Disc Therapy", McCall.

*Primary Examiner*—Michael H. Thaler

*Attorney, Agent, or Firm*—Woodcock, Washburn, Kurtz, Mackiewicz & Norris

[57] ABSTRACT

Disclosed is a device for treating physiological disorders by the application of pressure and a method of using such a device. The device comprises a mounting having two clamping members which are movable with respect to one another for clamping a portion of the human body therebetween. At least one of these members terminates in a blunt surface which is adapted to apply pressure to a selected point on the surface of that portion of the body. A biasing mechanism such as a spring is provided for applying a clamping force to retain the clamping members biased toward one another. In one embodiment the blunt surface projects from a shoulder which prevents the surface from penetrating the skin on the application of pressure thereto. The blunt surface has a surface area large enough such that specific points of the body may be stimulated without penetrating the skin and yet small enough such that undesired points will not be stimulated. Additionally, a method is disclosed for using such a device for the treatment of disorders by the application of pressure to the external ear. The method includes the selecting of the desired point to which pressure is to be applied from an acupuncture/acupressure map of the ear. The blunt surface is then positioned adjacent the selected point and stimulation is effected by the application of pressure to the point through the blunt surface.

11 Claims, 9 Drawing Figures

ACUPRESSURE DEVICE

This is a continuation of application Ser. No. 897,278, filed Apr. 17, 1978, now abandoned.

BACKGROUND OF THE INVENTION

The present invention relates in general to the treatment of physiological disorders and in particular it relates to the treatment of physiological disorders by the application of pressure to selected regions of the body.

The treatment of physiological disorders by means of acupuncture is well known. Acupuncture is the method of employing fine punctures of the skin, at spatially, exactly defined points in order to treat specific disorders. One example of such treatment is the treatment of obesity by the insertion of an acupuncture needle at a selected point on the external ear. In this regard, see U.S. Pat. No. 3,933,077 to Kim. Other disorders treated by acupuncture techniques used on the external ear include sciatica, neck pain and shoulder pain. Another example of such treatment is disclosed in U.S. Pat. No. 3,923,064 to Leupold, which discloses that toothache may be treated by applying an acupuncture needle to a selected region of the index finger.

One problem which has been noted with acupuncture is that a skilled practitioner is generally required to administer the treatment which thus eliminates the possibility of frequent treatment for certain disorders. To eliminate this problem, in the treatment of obesity for example, staples and rings which pierce the ear have been used such that a continuous treatment may be effected. However, experience has shown that when acupuncture points are continuously stimulated for long periods of time the patient will acclimate to the stimulation and a rest period is required before further stimulation is effective. This condition is known as "acupuncture point fatigue" and, in the case of acupuncture point fatigue, removal of the staples and rings which pierce the external ear is difficult.

Another disadvantage of acupuncture techniques is that since the skin is punctured with the acupuncture needle, a danger of infection is presented. Accordingly, acupressure, rather than acupuncture has been employed.

Acupressure is the application of pressure to selected points of the body, which pressure is not sufficient to pierce the skin, but which is still an effective treatment for certain disorders. In the article entitled "Auricular ACI Mold Pressure Therapy and ACU Mold Disk Therapy" by Dr. Francis J. McCall, McCall Research Development Laboratories Ltd., Lansing, Illinois, a device is disclosed which employs acupressure to the external ear for the treatment of obesity and other disorders. The McCall device employs an ear-mold having a projection thereon which is used to apply pressure to specific points of the external ear. However, the ear-mold described by McCall is custom designed to the anatomy of the user. The aforementioned Leupold patent discloses an acupressure device for applying pressure to the index finger for the treatment of toothache.

It is an object of the present invention to provide a device which is designed such that pressure may be applied to a selected region of the body by the patient on a frequent basis without the assistance of a medical practioner.

It is a further object of the present invention to provide an acupressure device which is useful for the application of pressure to various regions of the body and yet which is easily removed when desired.

It is still a further object of the present invention to provide such a device which does not penetrate or puncture the skin.

It is still a further object of the present invention to provide an acupressure device which is capable of applying pressure to selected regions of the body, especially the external ear, for the treatment of various disorders and which need not be custom designed for each user.

SUMMARY OF THE INVENTION

These and other objects of the present invention are accomplished by means of a device for treating physiological disorders comprising a mounting having two clamping members movable with respect to one and another for clamping a portion of the body therebetween. At least one of these members terminates in a blunt surface which is adapted to apply pressure to a selected point on the surface of that portion of the body. A biasing means is provided for applying a clamping force to retain the clamping members biased toward one another. In one embodiment the biasing means is integral with the mounting. The dimensions of the blunt surface are selected such that they are small enough that localized pressure may be applied to selected acupuncture/acupressure points on the body without encroaching upon adjacent acupuncture/acupressure points. In one embodiment the biasing means applies a clamping force which merely retains the device in the proper location. Stimulation may then be effected through an action of the user by manually increasing the clamping force.

Additionally, a method is disclosed for using such a device for treatment of various disorders by the application of pressure to the external ear. A method of selecting the desired point to which pressure is to be applied from an acupuncture/acupressure map of the ear and for locating the device adjacent to that point and for applying a sufficient clamping force to retain the device against the skin at that point is disclosed. The present invention will be more fully understood by reference to the accompanying drawings in which.

DETAILED DESCRIPTION OF THE INVENTION

Figure 1:
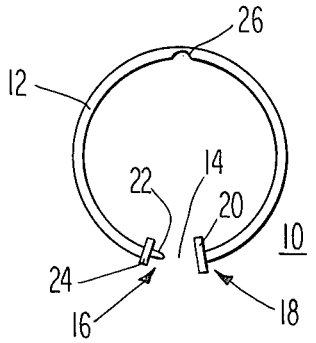
FIGS. 1–5 are plan views of various embodiments of the present invention.

Referring now to FIG. 1, a first embodiment of a device for treating physiological disorders of the body by pressure is shown generally at 10. The device comprises a mounting 12 which is preferably a circular or ring shaped member having an opening or gap 14 therein. The mounting 12 is made of a band of flexible material and may be comprised of either a plastic material or metal. The mounting 12 terminates in two diametrically opposed clamping members 16 and 18 situated at the opening 14. In the embodiment shown in FIG. 1, the clamping members 16 and 18 are movable toward one another through the action of a bias applied to them by a flexing of a portion of the mounting 12 intermediate the clamping members 16 and 18. Further this bias is sufficient to apply a clamping force to a selected portion of the body which is to be situated in the gap 14.

One of the clamping members 18 terminates in a pad surface 20 which is designed to have a surface area large enough such that a minimum pressure is transferred to the surface of the skin when the device is applied to effect stimulation. The other clamping member 16 terminates in a blunt surface 22 having a surface area which is smaller than the pad surface 20. This blunt surface may be a planar or a rounded surface (the rounded surface being preferred), however it is essential that the surface 20 be sufficiently blunt that the skin is not pierced or punctured due to the bias supplied through the mounting 12. Additionally, in order to prevent the blunt surface 22 from penetrating the skin, the clamping member 16 shown in FIG. 1 also includes a shoulder portion 24 from which the blunt surface 22 projects.

While the surface 22 must be blunt, it must have a surface area small enough such that acupressure points adjacent to the point to be stimulated are not affected. Accordingly, applicant has found that when the device is designed for use on the external ear and when the blunt surface 22 is planar, it should have a surface area less than about 3 $mm^2$. If the surface 22 is rounded it should have a radius of curvature less than about 1 mm and in fact a radius of curvature of 0.625 mm is preferred.

The mounting shown in FIG. 1 may, in one embodiment, narrow to a thin section 26 at the middle therof to increase the flexibility of the mounting while at the same time maintaining a certain stiffness so that the mounting will not collapse when squeezed.

While the device of the present invention is not so limited, it is most useful for applying stimulation to the auricle or external ear. Since the auricle contains numerous nerve endings and blood vessels, it is desirable that a minimum amount of pressure be exerted against the auricle during the time when the acupressure device is worn and stimulation is not desired. Thus, the clamping force applied to clamping members 16 and 18 should be only sufficient to retain the device 10 in the proper position since if this clamping force is too great the device will become uncomfortable to the wearer. Accordingly, the spacing between the pad surface 20 and the blunt surface 22 should be sufficiently wide in its relaxed position so that a relatively small clamping force is exerted against the auricle. In the preferred embodiment the force is just sufficient to retain the device over the point to be stimulated. Alternatively, the force may be less than this and the device then hangs relatively loosely on the ear to be moved by the user to the desired position to effect stimulation. In the embodiment shown in FIG. 1 stimulation is achieved by compressing the mounting 12 with the fingers.

Figure 2A:
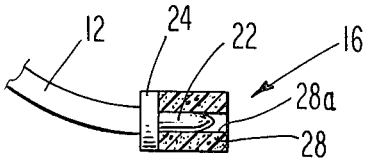
FIGS. 2A, 3A and 5A are partial sectional views of devices shown in FIGS. 2, 3, and 5 respectively.
Figure 2:
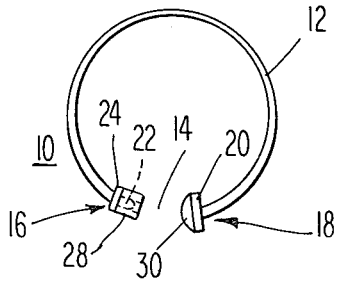

In order to imply a minimum clamping force when no stimulation is desired and to increase comfort to the user, a preferred embodiment of the present invention as shown in FIG. 2 may be employed. As shown in FIG. 2, each of the clamping members 16 and 18 are covered with a first and second compressive means 28 and 30. These compressive means may be comprised of, for example, a rubber or foam-like material. When used to apply pressure to the auricle, the second compressive means 30 attached to the pad surface 20 cushions the back of the auricle when a clamping force is applied thereto. Further, as best shown in FIG. 2A which is a cross sectional view of the clamping member 16 shown in FIG. 2, the first compressive means 28 is a cylindrical body which surrounds the blunt surface 22 and which abuts the shoulder means 24. The compressive means 28 has a bore **28*a* therein which extends beyond the extremity of the blunt surface 22 such that when stimulation is not desired the clamping forces applied to the clamping members 16 and 18 are distributed and cushioned by the compressive means 28 to prevent the blunt surface 22 from projecting through the bore and pressing upon the auricle. However, when the device 10 is compressed by the user, the compressive means 28 is depressed and the blunt surface 22 emerges from the bore 28*a*** to effect the desired stimulation.

Figure 3A:
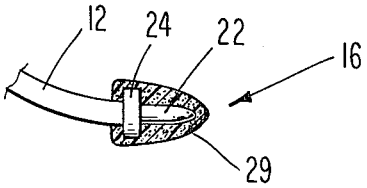
Figure 3:
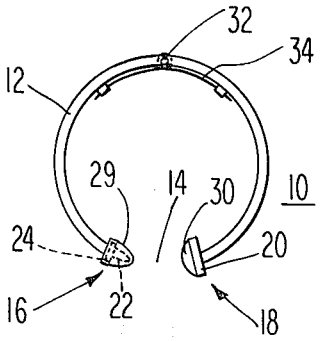

Referring now to FIG. 3, still another embodiment of the present invention is shown which is similar to that described in connection with FIG. 2 except that when the device in FIG. 3 is compressed by the user the blunt surface 22 does not project from the compressive means 29 since, as may best be seen from FIG. 3A, the compressive means 29 has a generally hemispherical rather than a cylindrical shape. The compressive means 29 entirely covers the blunt surface 22 and surrounds the shoulder means 24. Preferably, the compressive means 29 should have a size large enough such that it cannot become lodged in the ear canal if it should become separated from the clamping member. When compressed by the user a force will be exerted through the compressive means 28 upon the proper location on the auricle. Additionally, in the embodiment shown in FIG. 3, the mounting 12 comprises a biasing means comprised of a hinge 32 and a spring 34 which apply a clamping force to the clamping members 18 and 20 in the same fashion as the integral biasing performed by the mounting 12 in the embodiment shown in FIGS. 1 and 2.

Figure 4:
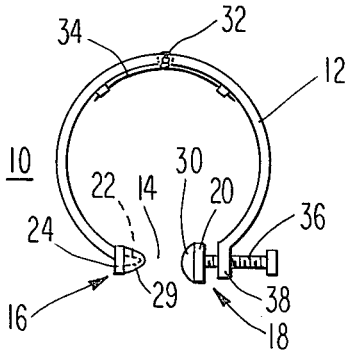

Referring now to FIG. 4, still another embodiment of the present invention is disclosed which is similar to that described in connection with FIG. 3 except that the biasing means further comprises a threaded pin 36 which mates with a threaded portion 38 of the mounting 12. One end of the threaded pin 36 is attached to the pad surface 20 in order that a biasing or clamping force may be applied to that portion of the body situated in the gap 14.

Figure 5:
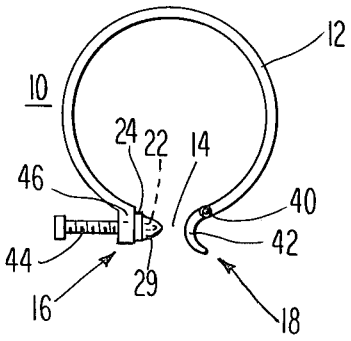
Figure 5A:
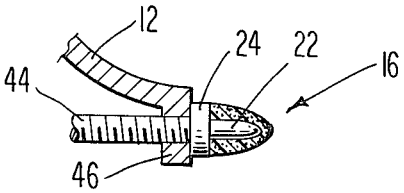

Referring now to FIG. 5, still another embodiment of the present invention is disclosed. FIG. 5 shows a mounting 12 having two clamping members 16 and 18. Clamping member 18 comprises a friction catch 40 attached to the mounting 12 by a hinge 42. The clamping member 16 comprises a blunt surface 22 which is surrounded by compressive means 29. Unlike the previous embodiments, the blunt surface 22 (FIG. 5A) is attached to one end of a threaded member 44 which mates with a threaded portion 46 of the mounting 12. Rotation of the threaded member 44 increases the amount by which the blunt surface 22 projects into the opening 14 and thus the amount of pressure applied to the selected portion of the body which is located there.

The embodiments shown in FIGS. 4 and 5 differ from those shown in FIGS. 1–3 in that the user or wearer need not apply an additional clamping force when stimulation is desired by compressing the mounting 12 with the finger. In the embodiment shown in FIG. 4, the spring 34 may apply an initial clamping force to retain the device in position and the threaded member 36 may be advanced into the opening 14 when stimulation is desired. In the embodiment shown in FIG. 5, the friction catch may apply an initial clamping force to the auricle and the advancement of the threaded member 44 into the opening 14 causes stimulation when desired. Alternatively, if desired, the devices shown in FIGS. 4 and 5 may be initially positioned with a clamping force applied through the threaded members 36 and 44 respectively, and stimulation may be affected by manual compression of the mounting 12.

Figure 6:
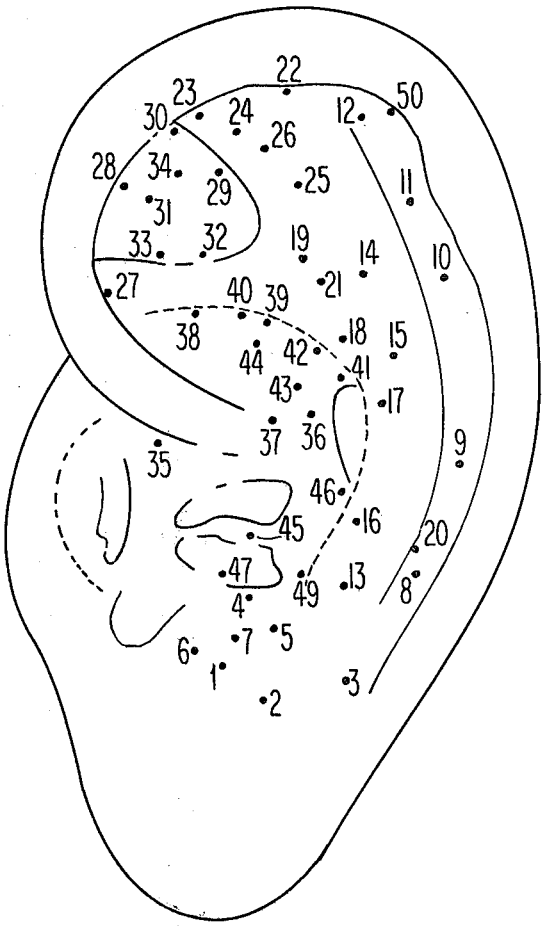
FIG. 6 is an acupuncture/acupressure map of the external ear.

Referring now to FIG. 6 an acupuncture/acupressure map of the external or auricle is shown in connection with the description of a method of using the devices in FIGS. 1–5. By the term acupuncture/acupressure map is meant any two dimensional surface or three dimensional model which indicates the location of a specific point or points which are to be stimulated for treatment to be effected. FIG. 6 shows a standard acupuncture/acupressure map of the external ear with selected acupuncture/acupressure points shown thereon. The following is a numerical index showing particular acupuncture/acupressure points and the location of the body which may be treated by the application of pressure to the correspondingly numbered points shown in the map of FIG. 6.

| Index of Acupuncture/Acupressure Points. | |
|---|---|
| 1 lower palate | 14 sacral vertebra |
| 2 tongue | 15 lumbar vertebra |
| 3 lower jowl | 16 neck |
| 4 brain point | 17 thorax |
| 5 occiput | 18 abdomen |
| 6 forehead | 19 heat point |
| 7 greater yang | 20 thyroid gland |
| 8 collarbone | 21 lumbago point |
| 9 shoulder joint | 22 toe |
| 10 elbow | 23 heel |
| 11 wrist | 24 ankle joint |
| 12 finger | 25 hip joint |
| 13 vertebra of neck | 26 knee joint |
| 27 sympathetic | 39 kidney |
| 28 uterus | 40 ureter |
| 29 shen-men | 41 liver |
| 30 lowering pressure point | 42 pancreas gall |
| 31 asthma point | 43 pancreatitis point |
| 32 thigh point | 44 drunk point |
| 33 constipation point | 45 heart |
| 34 hepatitis point | 46 spleen |
| 35 mouth | 47 lung |
| 36 stomach | 48 brain stem |
| 37 duodenum | 49 toothache point |
| 38 bladder | 50 minor occipital nerve |

For example, the application of pressure to the point 36 (stomach) is used in the treatment of obesity. Additionally, the application of pressure to the point 47 (lung) has been used to eliminate the urge for some individuals to smoke. Moreover application of pressure to points 5, 27 and 29 has been used to treat nausea and vomiting. For a more detailed acupuncture/acupressure map of the ear see "Ear Acupuncture", by The Nanking Army Ear Acupuncture Team, translated by Helena L. Huang, published by Rodale Press, Emmaus, Pa., pp. 34 and 35.

In practicing the method of the present invention, an acupuncture/acupressure map similar to that shown in FIG. 6A or similar to that described in the aforementioned publication may be employed. In any event, such a map or model of the ear is consulted and a specific region of the external ear is selected depending upon the disorder to be treated. For example, if obesity is to be treated, the region around point 36 (stomach) is selected. Next a device similar to that described in connection with FIGS. 1–5 is chosen and the blunt surface 22 thereof is located adjacent the selected region. A point within that region is then stimulated for periods lasting approximately one minute by the application of pressure thereto through the blunt surface 22, which pressure is not sufficient to pierce the skin. If the embodiments described in FIGS. 1–3 are employed, stimulation is affected by the manual application of pressure to the mounting 12. If the embodiments of FIGS. 4 or 5 are emloyed, stimulation may be effected either manually or by the advancement of the threaded members 36 or 44 respectively into the gap 14.

In the preferred embodiment of the present method, the step of locating the aforementioned devices adjacent the point to be stimulated further includes the step of biasing the clamping members of the device toward one another in order that an initial clamping force may be exerted on the selected region. In this manner the device 10 is retained in the proper location and the user may repeatedly stimulate the desired point without having to reposition the device each time stimulation is desired.

While particular embodiments of the invention have been shown and described, it will, of course, be understood that various modifications may be made without departing from the principles of the invention. The appended claims are, therefore, intended to cover any such modifications within the true spirit and scope of the invention.

What is claimed is:

1. A device for treating physiological disorders of the human body by pressure, said device comprising:

a mounting having two clamping members movable with respect to one another for clamping a selected portion of the external ear therebetween, one of said members having a shoulder portion with a rigid projection extending therefrom, said projection terminating in a blunt planar surface having a surface area less than 3 $mm^2$, the shoulder portion located relative to said projection so as to preclude penetration of the skin by said projection, the length of said projection being greater than 1 mm, whereby said surface is adapted to abut and apply pressure to said selected portion on one side of the ear, the other of said clamping members terminating in a pad surface with an area greater than the area of said blunt surface and adapted to abut the other side of the ear; and a biasing means for applying a clamping force to said clamping members.

2. The device of claim 1 wherein said at least one clamping member further comprises a compressive means surrounding said blunt surface.

3. The device of claim 2 wherein said compressive means is a cylindrically shaped body having a bore therein, said blunt surface being projected from said bore when said compressive means is depressed.

4. The device of claim 2 wherein said compressive means comprises rubber.

5. The device of claim 2 wherein said compressive means comprises foam.

6. The device of claim 2 wherein said compressive means is a hemispherical body surrounding said blunt surface and abutting said shoulder.

7. The device of claim 1 wherein said biasing means is integral with said mounting.

8. The device of claim 7 wherein said mounting and said integral biasing means comprises a flexible band.

9. The device of claim 1 wherein said mounting comprises two sections joined by a hinge and wherein said biasing means comprises a spring attached to said mounting.

10. The device of claim 1 wherein said mounting further comprises a threaded portion and wherein said biasing means comprises a threaded pin mating with said threaded portion, one of said clamping members being attached to the end of said pin.

11. A device for treating physiological disorders of the human body by pressure, said device comprising:

a mounting having two clamping members movable with respect to one another for clamping a selected portion of the external ear therebetween, one of said members having a shoulder portion with a rigid projection extending therefrom, said projection terminating in a blunt rounded hemispherical surface having a radius of curvature less than 1 mm, the shoulder portion located relative to said projection so as to preclude penetration of the skin by said projection, the length of said projection being greater than said radium of curvature whereby said surface is adapted to abut and apply pressure to said selected portion on one side of the ear, the other of said clamping members terminating in a pad surface with an area greater than the area of said blunt surface and adapted to abut the other side of said ear; and a biasing means for applying a clamping force to said clamping members.

* * * * *